United States Patent [19]

Welch

[11] Patent Number: 5,076,805

[45] Date of Patent: Dec. 31, 1991

[54] ADAPTOR FOR HAND HELD POWER TOOL

[76] Inventor: Thomas F. Welch, 5 Pinefield Rd., Hilton Head Island, S.C. 29926

[21] Appl. No.: 653,042

[22] Filed: Feb. 11, 1991

[51] Int. Cl.[5] ..... H01R 3/00

[52] U.S. Cl. ..... 439/568; 310/50; 439/500

[58] Field of Search ..... 439/500, 502, 504, 506, 439/350, 568; 81/54; 310/50; 307/64

[56] References Cited

U.S. PATENT DOCUMENTS

| | | | |
|---|---|---|---|
| 3,843,224 | 10/1974 | Gerhe et al. | 439/350 X |
| 4,835,410 | 5/1989 | Bhagwat et al. | 310/50 X |
| 4,936,796 | 6/1990 | Anderson | 439/504 X |

*Primary Examiner*—Eugene F. Desmond
*Attorney, Agent, or Firm*—Bailey & Hardaway

[57] ABSTRACT

A hand-held power tool having an elongated internal vertical housing 12 in a handle 11 with opposed vertical electrical housing contacts 13 carried adjacent respective opposed vertical side walls 12*a* and 12*b* of the housing is provided with an adaptor plug 14 and connector D for substituting an external automotive battery 21 for internal batteries for supplying power to the tool. An elongated adaptor body member A is carried for vertical disposition within the housing 12. A pair of opposed electrical adaptor contacts B adjacent one end of the body member A is resiliently biased laterally outwardly thereof into engagement with respective vertical electrical housing contacts 13. A conforming member C spaced longitudinally along the adaptor body member A from the adaptor contacts B aids in guiding and positioning the elongated adaptor body member A in the housing 12. A connector D for battery contacts is connected to the adaptor contacts for energizing the hand held power tool from an external automotive battery 21. An external automotive battery may thereby be readily substituted for internal batteries in a hand held power tool.

5 Claims, 2 Drawing Sheets

ADAPTOR FOR HAND HELD POWER TOOL

BACKGROUND OF THE INVENTION

This invention relates to an adaptor plug and connector which facilitates substitution of an external automotive battery for the standard internal batteries which supply power to a hand-held power tool of the type having an elongated internal vertical housing in a handle with opposed vertical electrical housing contacts carried adjacent respective opposed vertical side walls of the housing.

As is well recognized in the art, conventional dry cell batteries have a short life in a device such as a hand-held power tool, especially when such a tool is frequently in use. The short battery life necessitates frequent battery replacement and consequent high costs, an annoying operating limitation. Moreover, although rechargeable batteries, such as those comprised of a nickel-cadmium alloy, sharply reduce the need for replacement, they require frequent recharging. Additionally, such batteries have a short shelf-life so that the electrical power therein dissipates relatively rapidly when in desuetude.

Various devices exist for substituting for power supplied by dry cell batteries, including that illustrated in U.S. Pat. No. 3,308,419, which shows a power supply means featuring a battery-shaped connector having helical contacts mounted thereon. Such a device, however, lacks means to guide and position same snugly within the elongated vertical housing of a power-operated tool or instrument; further, the helical contacts are not configured to engage the above-described vertical contacts within an elongated vertical housing. U.S. Pat. No. 4,946,396 illustrates a similar device, suitable for insertion into a rectangular battery box, wherein two contact holders at their respective ends each carry a retractable, cylindrical contact. Each contact is configured to cooperate with circular contacts in the battery holder of the power-operated device as a result of the positioning of a pair of foldable plugs which carry respective contacts. However, the shape cf such contacts renders the disclosed device unsuitable for engaging opposed vertical housing contacts within the battery compartment of a hand-held power tool. Finally, devices such as that disclosed in U.S. Pat. No. 4,835,410 feature a combined corded/cordless system for power-operated tools, but contemplate only internal batteries for supplying the DC power source, rather than an external automotive battery.

Accordingly, it is an important object of the invention to provide a hand-held power tool capable of being powered either by internal batteries or alternatively by an external automotive battery.

Another important object of the invention is to provide an adaptor which cooperates with diametrically opposed electrical vertical contacts carried within an elongated vertical housing.

Another important object of the invention is to permit the substitution an alternative DC power source for the internal batteries in a hand-held power tool having diametrically opposed electrical vertical contacts carried within the elongated vertical housing of the tool.

Still another important object of the invention is to provide an adaptor which includes longitudinally spaced conforming members to aid in guiding and positioning the adaptor within the battery housing of a hand-held power tool.

SUMMARY OF THE INVENTION

It has been found that a hand-held power tool having an elongated internal vertical housing in a handle with opposed vertical electrical housing contacts may be supplied with an adaptor which facilitates substitution of power from an external automotive battery for power from internal batteries. The adaptor includes an elongated adaptor body member which is configured for vertical disposition within in the elongated vertical housing. Enclosed within the adaptor body member is a pair of opposed electrical adaptor contacts which engage opposed vertical electrical housing contacts carried within the side walls of the housing. The adaptor contacts both protrude out of one end of the adaptor body member and are resiliently biased laterally outwardly thereof. The adaptor additionally includes at least one conforming member spaced longitudinally along the adaptor body member from the adaptor contacts to aid in guiding and positioning the elongated adaptor body member within the housing. Finally, the adaptor is provides with a connector to connect the external automotive battery to the adaptor contacts. The invention thereby allows for an external automotive battery to be readily substituted for internal batteries in a hand-held power tool.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate an adaptor plug and connector for substituting an external automotive battery for internal batteries for supplying power to a hand held power tool of the type having an elongated internal vertical housing in a handle with opposed electrical housing contacts carried adjacent respective opposed vertical side walls of the housing. An elongated adaptor body member A is carried for vertical disposition within the housing. A pair of opposed electrical adaptor contacts B adjacent one end of the body member is resiliently biased laterally outwardly of the body into engagement with respective vertical electrical housing contacts. A conforming member C spaced longitudinally along the adaptor body member from the adaptor contacts aids in guiding and positioning the elongated adaptor body member in the housing. A connector D for battery contacts is connected to the adaptor contacts for energizing the hand held power tool from an external automotive battery. Thus, an external automotive battery may be readily substituted for internal batteries in a hand-held power tool.

Figure 1:
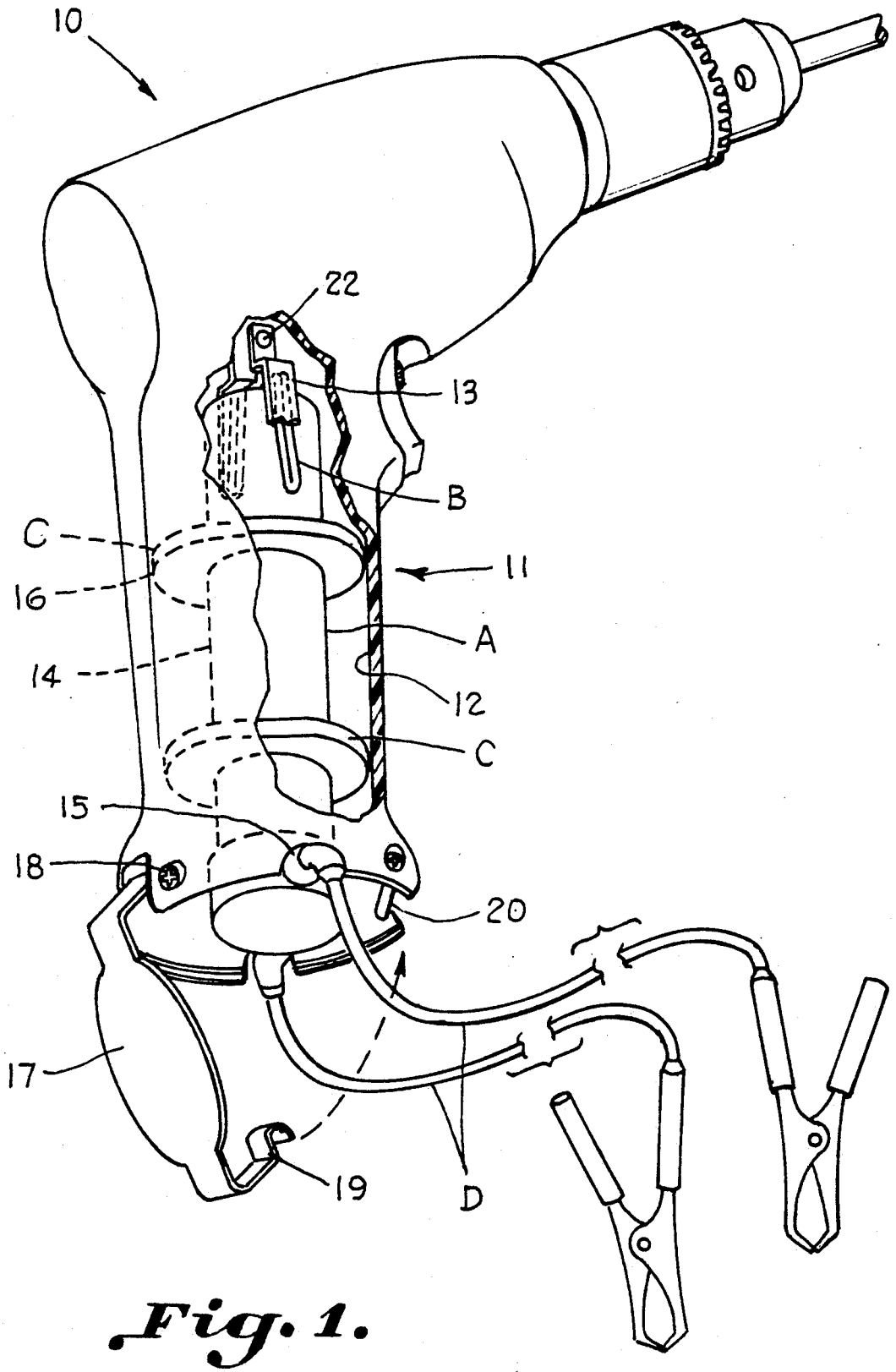
FIG. 1 is a perspective view illustrating the positioning of the adaptor, shown in broken lines, within the battery compartment of a hand-held power tool.
Figures 2, 3:
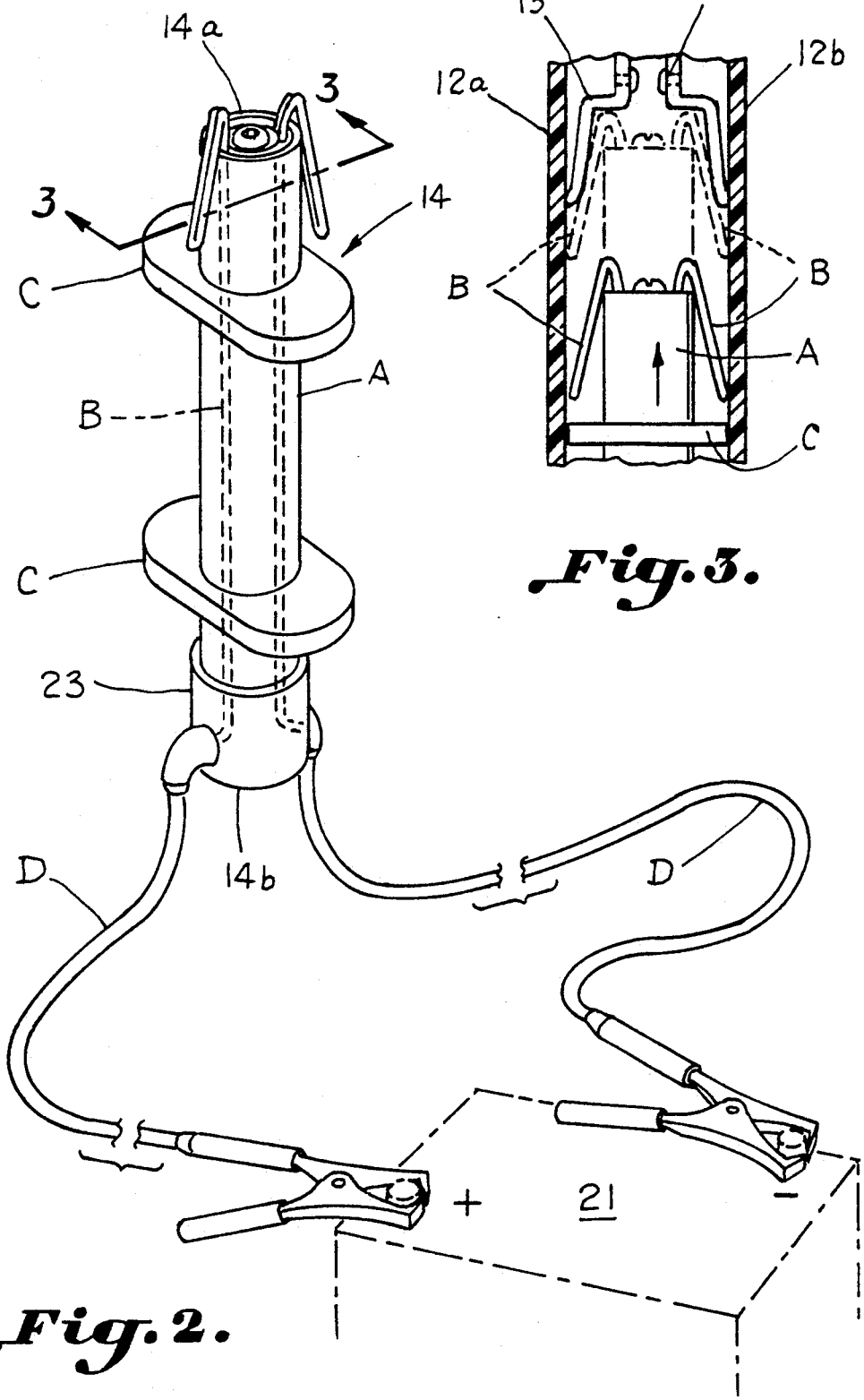
FIG. 2 is a perspective view illustrating the various operating components of the adaptor constructed in accordance with a preferred embodiment of the invention.
FIG. 3 is a partial longitudinal sectional elevation view, taken along line 3—3 of FIG. 2, illustrating the adaptor inserted between the opposed vertical walls of the housing of the power tool handle, showing in solid lines the adaptor with its contacts biased laterally outwardly, and in broken lines the adaptor in its fully inserted position, with the adaptor contacts shown depressed laterally inwardly, resiliently engaging the opposed electrical vertical housing contacts.

Referring to FIGS. 1 and 2, a hand-held power tool in the form of drill 10 is shown with an elongated handle 11, the hollow interior of which is bounded by an elongated internal vertical housing 12. Carried within housing 12 is a pair of opposed vertical electrical housing contacts 13, connected to the electrical interior of drill 10 by suitable fasteners as at 22. An adaptor, shown generally at 14, is illustrated in FIG. 1 as being is contained within housing 12. A pair of opposed electrical adaptor contacts B are enclosed within the body member A and protrude out of ends 14*a* and 14*b* thereof. As best seen in FIG. 2, the adaptor contacts B at end 14*b* are bent, preferably at right angles, away from the longitudinal axis of body member A. The bent ends of adaptor contacts B extend through corresponding openings 15 in the handle 11 and are connected to connectors D, which in turn engage the terminals of an external automotive battery 21. Auxiliary devices such as a selectable voltage switch may be included. Such an accessory may be interposed between segments of connectors D such as at the gaps therein illustrated and indicated by brackets in FIGS. 1 and 2.

The preferred embodiment may additionally include a vertical adjustment cap 23 carried adjacent end 14*b* of elongated body member A. The body member A may be provided with external threads proximate end 14*b*, and vertical adjustment cap 23 may be internally threaded to mate with the external threads. By rotating the cap 23, one can increase or decrease the vertical length of adaptor 14 to precisely correspond to the length of the elongated vertical housing 12 of a given hand-held power tool 10. Any other relationship can exist between vertical adjustment cap 23 and body member A to adjust the length of adaptor 14. For example, the cap may be fitted so as to be slidably mounted onto the body member.

External circumferential edges 16 of conforming members C bear against the walls of the housing 12 to guide and position the adaptor 14 within the housing 12 as shown. Additional aid in positioning is provided by the adaptor contacts B, which, through their resilient outward biasing, bear against housing contacts 13 as explained below to help retain the adaptor 14 within the housing 12. An end closure member 17 is pivotally mounted to the handle 11 as at 18. The closure member 17 terminates in a latch 19, which engages transverse member 20 when closure member 17 swings in the direction indicated by the arrow to a closed position, thereby securing the adaptor 14 within the housing 12.

Referring to FIG. 3, the adaptor is shown inserted between opposed vertical side walls 12*a* and 12*b* of housing 12. The adaptor is positioned by conforming member C, which bears against both walls. At the adaptor position indicated by the solid lines, the opposed electrical contacts B are biased laterally outwardly of elongated adaptor body member A. The adaptor is urged upwardly in the direction indicated by the arrow until it reaches its fully inserted position, shown in broken lines, where the adaptor contacts B effectively engage the opposed vertical electrical housing contacts 13. This engagement is accomplished through the bearing of each adaptor contact B against the inside face of a corresponding housing contact 13. In the fully inserted position, the opposed electrical adaptor contacts B are depressed laterally inwardly to elongated body member A by the opposed vertical electrical housing contacts 13. In this manner, the adaptor contacts B are assured of maintaining suitable contact with housing contacts 13 to transmit electrical power from an external automotive battery to the hand-held power tool.

While a preferred embodiment of the invention has been described using specific terms, such description is for illustrative purposes only, and it is to be understood that changes and variations may be made without departing from the spirit or scope of the following claims.

What is claimed is:

1. An adaptor plug and connector for substituting an external automotive battery for internal batteries for supplying power to a hand held power tool of the type having an elongated internal vertical housing in a handle with opposed vertical electrical housing contacts carried adjacent respective opposed vertical side walls of said housing comprising:

an elongated adaptor body member carried for vertical disposition within said housing;

a pair of opposed electrical adaptor contacts adjacent one end of said body member being resiliently biased laterally outwardly of said body into engagement with respective vertical electrical housing contacts;

a conforming member longitudinally spaced along said adaptor body member from said adaptor contacts for aiding in guiding and positioning said elongated adaptor body member in said housing; and a connector for battery contacts connected to said adaptor contacts for energizing the hand held power tool from an external automotive battery;

whereby an external automotive battery may be readily substituted for internal batteries in a hand held power tool.

2. The structure set forth in claim 1 wherein said pair of opposed electrical adaptor contacts include downturned members constructed of resilient conductive material having an outwardly extending camming portion resiliently engaging said electrical housing contacts.

3. The structure set forth in claim 1 wherein said conforming member is a washer constructed of flexible resilient material.

4. The structure set forth in claim 1 further comprising a vertical adjustment cap carried on one end of said elongated adaptor body member for adjusting the length of said adaptor plug.

5. The structure set forth in claim 4 wherein said vertical adjustment cap is threadably mounted onto said one end of said elongated adaptor body member.

* * * * *